US006120038A

United States Patent [19]

Dong et al.

[11] Patent Number: 6,120,038

[45] **Date of Patent: *Sep. 19, 2000**

[54] DETACHABLE SKATE FRAME

[75] Inventors: Annette K. Dong, Renton; Craig Sorensen, Port Orchard, both of Wash.

[73] Assignee: K-2 Corporation, Vashon, Wash.

[ * ] Notice: This patent issued on a continued prosecution application filed under 37 CFR 1.53(d), and is subject to the twenty year patent term provisions of 35 U.S.C. 154(a)(2).

[21] Appl. No.: 09/075,393

[22] Filed: May 8, 1998

[51] Int. Cl.[7] ..... A63C 17/18; A63C 1/04

[52] U.S. Cl. ..... 280/7.13; 280/11.33; 280/613

[58] Field of Search ..... 280/7.13, 11.19, 280/11.12, 14.2, 11.27, 11.3, 11.33, 11.31, 613, 607, 615, 614

[56] References Cited

U.S. PATENT DOCUMENTS

| | | | |
|---|---|---|---|
| 83,756 | 11/1868 | Brady | 280/11.3 |
| 779,417 | 1/1905 | Pinkle | 280/11.3 |
| 1,405,951 | 2/1922 | St. Pierre | 280/713 |
| 2,118,892 | 5/1938 | Mays | 280/7.13 |
| 2,244,719 | 6/1941 | Mansfield . | |
| 3,061,325 | 10/1962 | Glass | 280/7.13 |
| 3,918,729 | 11/1975 | Peters | 280/7.13 |
| 4,842,293 | 6/1989 | Rochard | 280/607 |
| 4,945,658 | 8/1990 | Provence | 280/615 |
| 5,108,125 | 4/1992 | Callegari | 280/615 |
| 5,224,730 | 7/1993 | Provence et al. | 280/615 |
| 5,303,940 | 4/1994 | Brandner | 280/7.13 |
| 5,507,506 | 4/1996 | Shadroui . | |
| 5,595,396 | 1/1997 | Bourdeau | 280/607 |
| 5,797,608 | 8/1998 | Haldemann . | |
| 5,887,877 | 3/1999 | Nero . | |
| 5,895,061 | 4/1999 | Gignoux . | |

FOREIGN PATENT DOCUMENTS

| | | | |
|---|---|---|---|
| 0 545 250 A2 | 6/1993 | European Pat. Off. . | |
| 0 551 704 A2 | 7/1993 | European Pat. Off. . | |
| 0 559 179 A1 | 9/1993 | European Pat. Off. . | |
| 2 718 652 | 10/1995 | France . | |
| 27 45 040 | 4/1979 | Germany . | |
| 92 08 063 | 10/1992 | Germany . | |
| 196 13 208 C2 | 10/1997 | Germany . | |
| 602 147 | 7/1978 | Switzerland . | |
| WO 94/20176 | 9/1994 | WIPO | 280/7.13 |
| WO 95/03101 | 2/1995 | WIPO . | |
| WO 97/26054 | 7/1997 | WIPO . | |
| WO 97/36655 | 10/1997 | WIPO . | |

*Primary Examiner*—Kevin Hurley
*Assistant Examiner*—Andrew J. Fischer
*Attorney, Agent, or Firm*—Christensen, O'Connor, Jonson and Kindness PLLC

[57] ABSTRACT

A skate (20) having a shoe portion (22) detachably secured to a plurality of longitudinally aligned skate wheels (26) for traversing a surface. The shoe portion having a sole defining a toe end (34) and a heel end (36). The skate further includes a frame (24) having an upper surface and a lower surface attached to the wheels. The skate also includes a heel latch member (78) rotatably attached to the frame for receiving and coupling to a heel binding attachment surface (54) located in the heel end of the sole to the frame. A toe latch member (76) is attached to the frame for receiving and coupling a toe binding member (42) located in the toe end of the sole to the frame. A lever arm (92) is attached to the heel latch member to selectively release or attach the shoe portion from the heel latch member. The heel latch member is rotatable about a vertical axis extending normal to the elongate direction of the frame. The heel latch member is rotatable between a locked position, wherein the heel attachment member is nested therein, and an open position, wherein the frame is detachable from the shoe portion to convert the skate into a convention shoe.

30 Claims, 3 Drawing Sheets

30
58
22
36
54
52
60b
56
60a
62b
62a
20
32
44
38
50b
34
40
50a
48b
48a
46
76
90a
82
90b
102
80
84
78
108
88
106
86
26
24
74
72
70
68b
74
72
26
70
68a
74
26
72
70
74
70
72
26

Fig. 3.
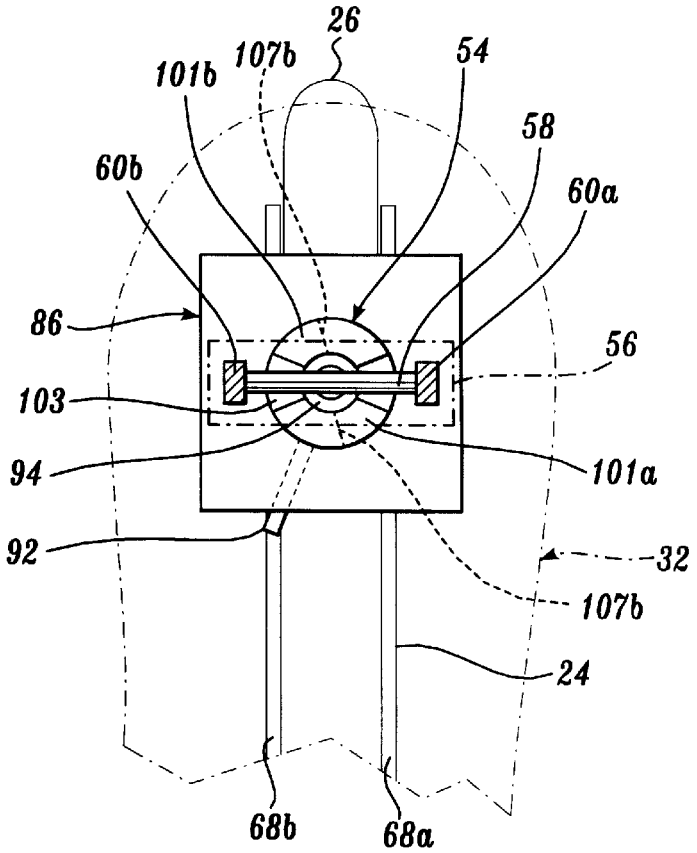
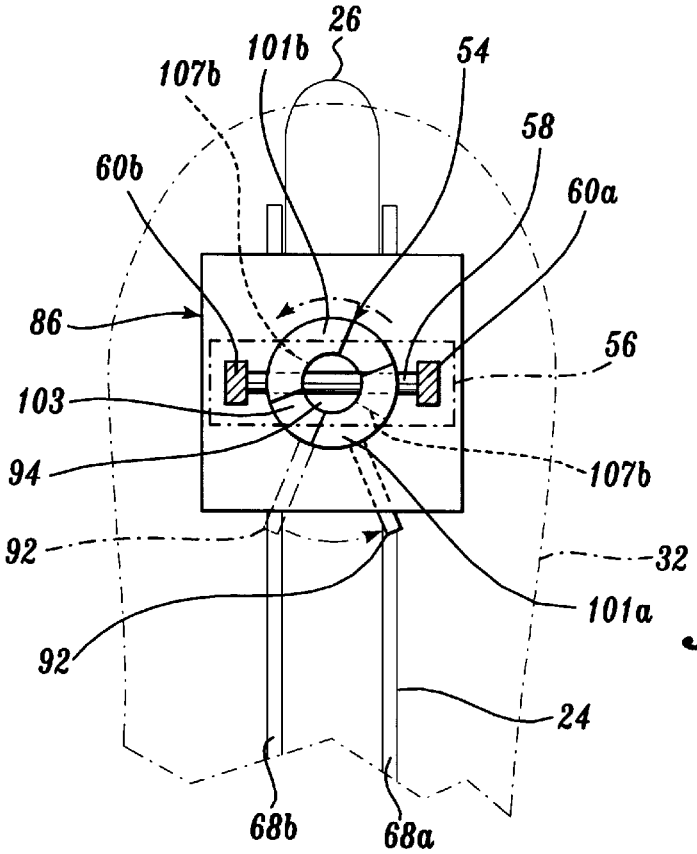
Fig. 4.

DETACHABLE SKATE FRAME

FIELD OF THE INVENTION

The present invention relates generally to skates and, in particular, to an in-line skate having an upper shoe portion detachable from the skate frame.

BACKGROUND OF THE INVENTION

Traditionally, in-line roller skates and ice skates generally include an upper shoe portion secured by a base to a frame that carries wheels or an ice blade. The upper shoe portion provides the support for the skater's foot, while the frame rigidly attaches the wheels or blade to the boot. Typically, the shoe portion is rigidly attached to an upper portion of the frame by a plurality of fasteners extending through the frame and into the sole of the shoe. Rigidly attaching the shoe portion to the frame requires the skater to have a second set of footwear to wear before and after skating or, because of other restrictions, the skater is unable to wear skates. Thus, a skater is often burdened with carrying additional footwear for walking or other physical activity when the skates are not in use or are not allowed.

Prior attempts to eliminate the need for additional footwear include devices that prevent the wheels of an in-line roller skate from turning, thereby allowing the skater to "walk" in their skates. However, because the sole of the boot is rigidly fastened to the skate frame and the skate frame itself is typically a rigid member, the skate is unable to flex during walking motion and, therefore, results in an unnatural and uncomfortable walking motion for the wearer. Other attempts at eliminating the need for additional footwear have included a separate, flexible shoe portion that is sized to be cradled within a hard skate shell attached to a frame. To attach the skate shell to the shoe, a skater inserts the shoe portion into the skate shell and fastens the shoe therein using a plurality of straps or similar fasteners. While a separate shoe portion insertable into a hard skate shell eliminates the need for additional footwear, the shoe is free to twist and bend within the skate shell, leading to less control in operation and an accompanying loss of safety. Additionally, fastening the shoe within the skate shell requires multiple adjustments to achieve, if possible, the desired alignment and tension on the shoe.

Still other attempts at eliminating the need for additional footwear have resulted in semi-flexible shoes that are detachable from a skate frame. Currently, these shoes have a relatively flexible upper shoe portion attached to a semi-rigid sole. A rigid highback extends upwardly from the heel portion of the sole and partially surrounds the ankle of the user. The semi-flexible shoe is securable to the frame by an over center cam latch that attaches to a complementary lip on the back of the upper shoe portion, thereby securing the shoe to the frame. Although the over center cam latch results in a more secure fastening of the shoe to the frame, the shoe, when removed from the frame, is still an uncomfortable shoe to walk in because of the semi-rigid sole and rigid highback. The external over center cam latch is also bulky and cumbersome to use.

Thus, there exists a need for a skate that has a flexible shoe portion and a detachable skate frame, such that the shoe portion is comfortable to walk in when removed from the skate frame and may be rigidly attached to the skate frame without undesirable movement of the shoe portion relative to the skate frame.

SUMMARY OF THE INVENTION

The present invention provides a skate having a shoe portion detachably secured to a bearing member for traversing a surface. The shoe portion has a sole defining a heel end, a toe end, and a metatarsal portion having a metatarsal head area. The skate further includes a first latch mechanism pivotably attached to the bearing member for receiving and coupling an attachment surface located in the sole of the shoe portion to the frame. A release mechanism is attached to the latch mechanism to selectively release the shoe portion from the latch mechanism.

In the preferred embodiment, the skate also includes an elongate frame having an upper surface and a lower surface. The frame is disposed between, and is attachable to, the sole to the bearing member. The skate also includes a second latch mechanism attached to the upper surface of the frame for receiving and coupling a toe attachment surface located in the toe end of the sole to the frame.

In another aspect of the present invention, the first latch mechanism is attached to the upper surface of the frame and is adapted to receive and couple a heel attachment surface located in the heel end of the sole to the frame. The first latch mechanism is configured as a slotted cylinder adapted to receive and couple the heel attachment surface to the frame. The first latch mechanism is pivotable about a vertical axis defined normal to the elongate direction of the frame to selectively secure the heel attachment surface to the frame. The first latch mechanism is pivotable between a closed position, wherein the heel attachment surface is nested therein, and an open position.

In yet another aspect of the present invention, the slots of the first latch mechanism are tapered to draw the heel attachment surface downwards against the frame as the first latch mechanism is pivoted into the closed position.

In still yet another aspect of the present invention, a first upwardly projecting mount is located on the upper surface of the frame. The mount is adapted to support the sole of the footwear at a predetermined location behind the metatarsal head area of the sole and provide stable support to the shoe portion during use of the skate.

The skate of the present invention provides several advantages over skates currently available in the art. The skate of the present invention provides a shoe portion that is detachable from the skate frame, thereby providing the skater with comfortable footwear when detached from the skate frame without requiring the skater to carry additional footwear. The skate of the present invention also provides a latch mechanism that enables a solid and secure fastening of the skate frame to the shoe portion, thereby maintaining a rigid connection between the shoe portion and the skate frame during use. Furthermore, the latch mechanism of the present invention not only locks the shoe in a stationary position during use, but also provides easy mounting and dismounting of the shoe to the skate frame. These and other advantages combine to define an in-line skate having a skate frame that is detachable from the shoe portion, thereby allowing the skater to convert the skate into comfortable footwear for walking when the shoe is detached from the skate frame.

BRIEF DESCRIPTION OF THE DRAWINGS

The foregoing aspects and many of the attendant advantages of this invention will become better understood by reference to the following detailed description, when taken in conjunction with the accompanying drawings, wherein:

FIG. 3 is a top view of the heel latch mechanism of the present invention shown in an open position with the heel binding surface inserted therein; and FIG. 4 is a top view of the heel attachment mechanism of the present invention shown in a locked position with the heel binding surface seated therein.

DETAILED DESCRIPTION OF THE PREFERRED EMBODIMENT

Figure 1:
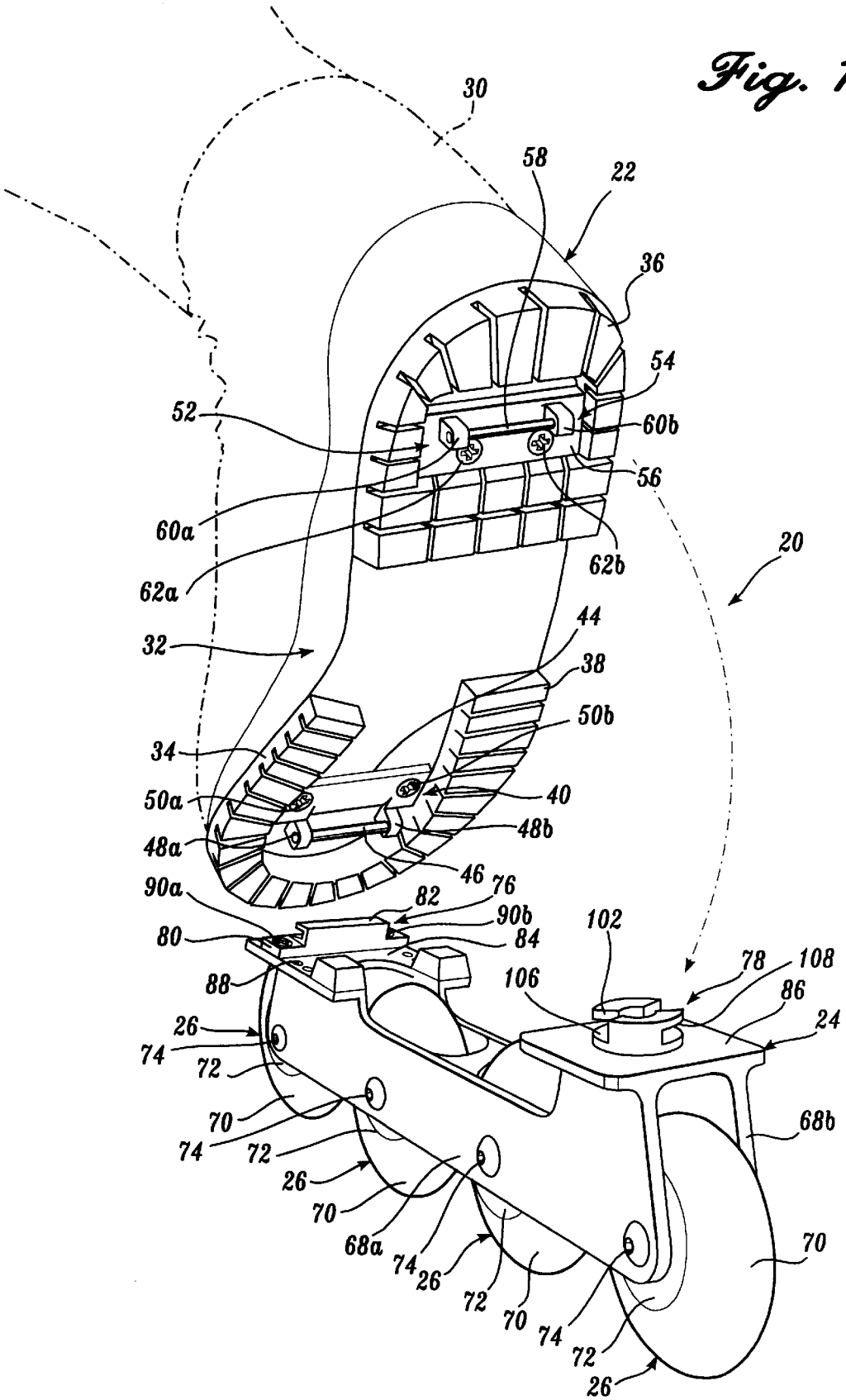
FIG. 1 is an environmental view of a skate with a detachable skate frame of the present invention having heel and toe attachment surfaces located in the sole of the boot and heel and toe attachment mechanisms located on the skate frame.

Referring to FIG. 1, a skate with a detachable skate frame constructed in accordance with a preferred embodiment of the present invention is illustrated in the form of an in-line roller skate 20. The skate 20 includes a shoe portion 22, a frame 24, and a bearing member in the form of a plurality of wheels 26. Although the preferred embodiment of the bearing member is a plurality of wheels 26, other types of bearing members capable of traversing a surface, such as an ice skate, are also within the scope of the present invention.

The shoe portion 22 has an upper shoe portion 30 (shown in phantom) and a base 32 having a toe end 34 and a heel end 36. The upper shoe portion 30 is preferably constructed from a flexible and durable natural or manmade material, such as leather, nylon fabric or canvas. The upper shoe portion 30 is also preferably constructed to include an internal or external rigid or semi-rigid ankle support (not shown) that stabilizes the ankle in the lateral and medial directions, while allowing fore and aft flexing. The upper shoe portion 30 is fixedly attached to the base 32 by being secured beneath a last board (not shown) by means well known in the art, such as glue or stitching. The upper shoe portion 30 also includes a conventional vamp (not shown) and vamp closure, including a lace (not shown), extending along the top of the foot from the toe area of the foot to the base of the shin of the skater.

The base 32 is constructed in a manner well known in the art from a resilient composite material and is attached to the upper shoe portion 30 by an adhesive, such as glue. Suitable materials for the base 32 include semi-rigid thermal plastic or thermal setting resins, such as carbon reinforced epoxy. Extending downwardly from the base 32 is an outsole including a tread 38. The outsole is preferably constructed from an elastomeric material such as rubber and is rigidly attached to the sole of the base 32 by molding or vulcanizing in place, or by an adhesive, such as glue.

Located in the toe end 34 of the base 32 is a recessed area defining a first cavity 40 extending generally between the ball and instep areas of the foot. A toe binding member 42 is rigidly attached to the base 32 within the first cavity 40. The toe binding member 42 is preferably constructed from a high strength material, such as aluminum, and includes a rectangular attachment plate 44 and a transverse toe attachment rod 46 spaced from the base 32. The attachment plate 44 has first and second arms 48*a* and 48*b* integrally formed therewith. The first and second arms 48*a* and 48*b* extend forwardly of the attachment plate 44, towards the toe end 34 of the base 32. The first and second arms 48*a* and 48*b* also depend downwardly from the attachment plate 44 for a predetermined distance. The downwardly depending ends of the first and second arms 48*a* and 48*b* do not extend beyond the depth of the tread 38 and, therefore, do not contact the ground surface when the shoe portion 22 is detached from the frame 24.

The toe attachment rod 46 is preferably constructed from a high strength material, such as steel or aluminum. The toe attachment rod 46 is rigidly secured between the first and second arms 48*a* and 48*b* of the toe binding member 42, such that a longitudinal axis extending between the ends of the toe attachment rod 46 is substantially normal to a longitudinal axis extending between the toe and heel ends 34 and 36 of the base 32. The toe binding member 42 is rigidly secured within the first cavity 40 by well known fasteners 50*a* and 50*b*, such as screws, extending vertically through the attachment plate 44 and into the sole of the base 32.

Located in the heel end 36 of the base 32 is a second recessed area defining a second cavity 52. The second cavity 52 is sized to receive a heel binding member 54 therein. The heel binding member 54 is configured similarly to the toe binding member 42 and includes a heel attachment plate 56 and a heel attachment rod 58. The heel attachment rod 58 is rigidly attached to the heel attachment plate 56 by integrally formed first and second arms 60*a* and 60*b* depending downwardly from the heel attachment plate 56. The heel attachment rod 58 extends between the first and second arms 60*a* and 60*b* such that when the heel binding member 54 is rigidly attached within the second cavity 52, a longitudinal axis extending between the ends of the heel attachment rod 58 is substantially perpendicular to a longitudinal axis extending between the toe and heel ends 34 and 36 of the base 32. The downwardly depending ends of the first and second arms 60*a* and 60*b* do not extend beyond the depth of the tread 38 surrounding the second cavity 52 and, therefore, the ends of the first and second arms 60*a* and 60*b* do not contact the ground surface when the shoe portion 22 is detached from the frame 24.

The heel binding member 54 is rigidly attached to the base 32 within the second cavity 52 by a pair of well known fasteners 62*a* and 62*b*, such as screws, extending vertically through the heel attachment plate 56 and into the sole of the base 32. Although it is preferred that the toe and heel binding members 42 and 54 be separate members, other configurations, such as toe and heel binding members integrally formed with the base of the shoe portion, are also within the scope of the present invention.

Still referring to FIG. 1, attention is now drawn to the detachable frame 24. The frame 24 is preferably configured as an elongate and inverted U-shaped member constructed from a high strength, lightweight material, such as aluminum or fiber reinforced thermoplastic or thermosetting polymers. The downwardly depending sides of the frame 24 define first and second side rails 68*a* and 68*b*. The first and second side rails 68*a* and 68*b* are held in spaced parallel disposition by the spine of the frame 24 such that a plurality of longitudinally aligned wheels 26 are receivable therebetween. Each wheel 26 is a conventional roller skate wheel well known in the art, and each wheel 26 has an elastomeric tire 70 mounted on a hub 72. Each wheel 26 is journaled on bearings between the first and second side rails 68*a* and 68*b* on an axle bolt 74. The axle bolt 74 extends between the first and second side rails 68*a* and 68*b* and laterally through a rotary bearing (not shown) centrally located in the hub 72 of each wheel 26. Preferably, the wheels 26 are journaled to the frame 24 in a longitudinally aligned arrangement. Further, when the shoe portion 22 is secured to the frame 24, the wheels 26 are positioned substantially midway between the lateral and medial sides of the shoe portion 22.

Figure 2:
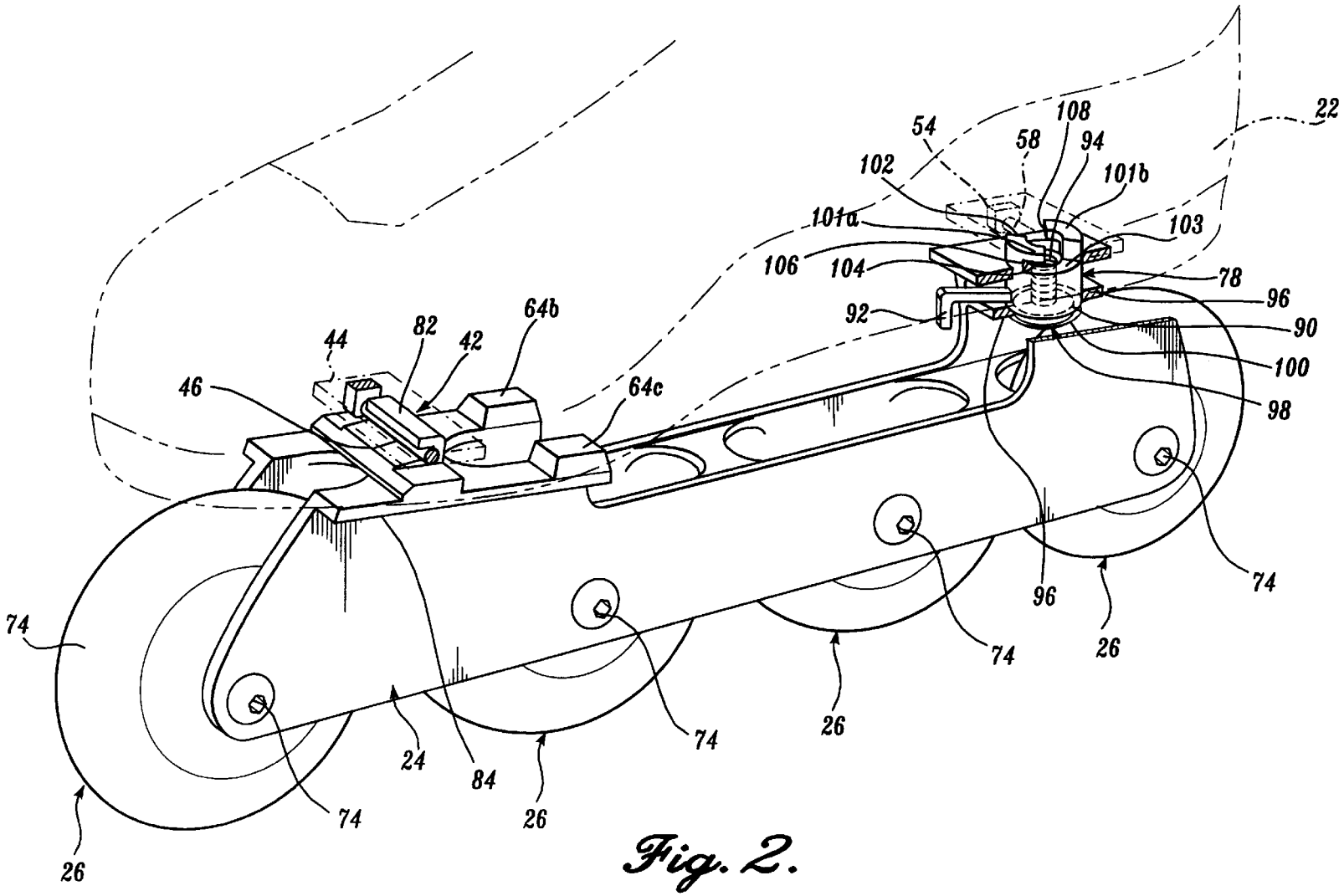
FIG. 2 is a perspective and partial cross section view of the skate of the present invention attached to the skate frame with the boot shown in phantom and the toe and heel latch mechanisms coupled to corresponding binding surfaces located in the toe and heel of the boot.

The shoe portion 22 is selectively attachable to the frame 24 by a toe latch member 76 and a heel latch member 78, as shown in FIGS. 1 and 2. The toe latch member 76 is preferably constructed from a high strength, lightweight material, such as aluminum, and has a rectangularly shaped base portion 80 and an upwardly projecting substantially C-shaped hook portion 82. The hook portion 82 is integrally formed with the base portion 80. The hook portion 82 is centrally located on the base portion 80 with the open portion thereof positioned towards the toe end 34 of the shoe portion 22 when the shoe is attached to the frame 24. The hook portion 82 projects upwardly from the base portion 80 for latching onto the toe attachment rod 46, as is described in greater detail below.

The toe latch member 76 is transversely and adjustably fastened to a forward platform 84 defined on the frame 24. The heel latch member 78 is rotatably attached to a rearward platform 86 defined by the frame 24. Preferably, both the forward and rearward platforms 84 and 86 are integrally formed with the spine of the frame 24. The forward platform 84 is substantially rectangular in configuration and has a width that is greater than the width between the first and second side rails 68*a* and 68*b*, such that the edges of the forward platform 84 defined by the width thereof overhang the first and second side rails 68*a* and 68*b*. The rearward end of the forward platform 84 has first and second elastomeric support mounts 64*a* and 64+ibprojecting upwardly therefrom. The first and second support mounts 64*a* and 64*b* are located on the lateral and medial sides of the forward platform 84 and are adapted to provide stable support to the metatarsal head area of the skater's foot when the shoe portion 22 is attached to the frame 24, as is described in greater detail below.

The forward platform 84 also has a plurality of holes 88 extending vertically through the portions thereof that overhang the first and second side rails 68*a* and 68*b*. The holes 88 are located on both sides of the forward platform 84 and are longitudinally aligned along the length thereof to define two rows of holes 88 along the sides of the forward platform 84. The toe latch member 76 is adjustably fastened along the length of the forward platform 84 by first and second fasteners 89*a* and 89*b*, such as screws, extending through holes (not shown) that extend vertically through the base portion 80 of the toe latch member 76. The vertically extending holes of the base portion 80 coaxially align in the vertical direction with the holes 88 defined along the sides of the forward platform 84, such that the toe latch member 76 may be adjusted on the forward platform 84 to accommodate shoes of different lengths. The toe latch member 76 may be adjusted longitudinally on the forward platform 84 by positioning the toe latch member 76 on the forward platform 84 to the desired length and reattaching the toe latch member 76 thereto by refastening the fasteners 89*a* and 89*b* into the vertically aligned holes of the base portion 80 and the forward platform 84. This enables a common frame to be mounted to differing sizes of boots.

As briefly noted above, the heel latch member 78 is rotatably mounted to the rearward platform 86. As may be seen better by referring to FIG. 2, the heel latch member 78 has a cylindrical housing 90 and a lever arm 92. The cylindrical housing 90 is preferably manufactured from a high strength material, such as aluminum, and includes a threaded central bore 94 extending vertically therethrough. The outside diameter of the housing 90 is sized to be slidably received within a vertically extending hole (not shown), centrally located on the rearward platform 86. The housing 90 is seated in the frame 24 on a horizontal web 96 located beneath the rearward platform 86. The web 96 has a horizontal surface extending between the first and second side rails 68*a* and 68*b* that is substantially parallel with the rearward platform 86. The web 96 includes a centrally located hole (not shown) that is coaxially aligned in the vertical direction with the central hole extending through the rearward platform 86. The diameter of the central hole located in the web 96 is smaller than the outside diameter of the housing 90, such that when the housing 90 is received within the rearward platform 84, the lower edge of the housing 90 is seated on the upper surface of the web 96.

Received within the lower end of the housing 90 and extending vertically through the central bore of the web 96 is an externally threaded bolt 98. The bolt 98 includes a threaded stem (not shown) and an enlarged head portion 100. The head portion 100 has an outside diameter that is greater than the diameter of the centrally located hole of the web 96, such that when the bolt 98 is threadably received within the lower end of the housing 90, the head portion 100 fastens the housing 90 to the frame 24 while allowing the housing 90 to rotate therein.

The upper end of the housing 90 projects upwardly from the rearward platform 86 and has a vertically extending first slot 102 bifurcating the upper end thereof. The first slot 102 extends normally to the upper surface of the housing 90 for a predetermined distance through the depth of the housing 90. The first slot 102 extends to a depth within the housing 90 such that the bottom thereof is located above the rearward platform 86 when the housing 90 is received within the rearward platform 86. The first slot 102 bifurcates the upper end of the housing 90 so that the heel attachment rod 58 of the heel binding member 54 is receivable therein, as is described in greater detail below.

The upper end of the housing 90 also has a transverse second slot 104 extending normally to the vertically extending first slot 102 on opposite sides of the housing 90, thereby defining first and second L-shaped detents 106 and 108. As may be seen better in FIG. 3, when viewed downwardly from the top of the frame 24, the first and second detents 106 and 108 are S-shaped and the ends thereof form first and second abutment surfaces 107*a* and 107*b* that extend radially outwardly from the central bore 94 to the outside surface of the housing 90 and extend vertically from the base to the top of the second slot 104.

Referring back to FIG. 2, the base of the detents 106 and 108, defined by the second slots 104, is located above the rearward platform 86 when housing 90 is received within the rearward platform 86. The first and second detents 106 and 108 are positioned on opposite sides of the upper end of the housing 90 and are connected by first slots 102 extending across the diameter of the upper end of the housing 90. The portion of the upper end of the housing 90 that overhangs the second slots 104 defines first and second lock flanges 101*a* and 101*b*. The lower ends of the free end of the first and second lock flanges 101*a* and 101*b* are chamfered. The chamfered ends of the lock flanges 101*a* and 101*b* facilitate the selective locking of the heel attachment rod 58 of the heel binding member 54 within the base of the first and second detents 106 and 108 and at least partially against the first and second abutment surfaces 107*a* and 107*b* when the shoe portion 22 is attached to the frame 24, as is described in greater detail below.

The heel latch member 78 may be selectively toggled between an open position and a locked position by the horizontally projecting L-shaped lever arm 92. Preferably, the lever arm 92 may be fastened to the housing 90 by being threadably received within an internally threaded bore (not shown) extending partially through the width of the housing 90. Preferably, the lever arm 92 is positioned on the housing 90 such that the stem of the lever arm 92 projects forwardly between the lower surface of the rearward platform 86 and the upper surface of the web 96 and towards the toe latch member 76. In this arrangement, the lower arm 92 is sheltered between the frame and boot to avoid unintentional movement thereof during use of the skate.

Attaching and detaching the shoe portion 22 to the frame 24 may be best understood by referring to FIGS. 1–4. To attach the shoe portion 22 to the frame 24, a skater would angle the toe end 34 of the shoe portion 22 downwardly towards the toe latch member 76, as seen in FIG. 1. As seen in FIG. 2, the skater would then slidably engage the toe attachment rod 46 within the hook portion 82 of the toe latch member 76 by pulling the foot rearwardly until the length of the toe attachment rod 46 is firmly received within the hook portion 82. After the toe attachment rod 46 is firmly received within the hook portion 82 of the toe latch member 76, the skater then applies a downward pressure on the heel end 36 of the shoe portion 22, such that the heel attachment rod 58 is received within the first slot 102 of the heel latch member 78. The skater applies continuous downward pressure on the heel end 36 until the heel attachment rod 58 is firmly received on the base surface 103 of the first slot 102 as seen in FIG. 3.

Referring now to FIG. 4, the skater locks the heel binding member 54 within the heel latch member 78 by rotating the lever arm 92 in a counterclockwise direction, as indicated by the arrow 110, about a vertical axis defined normal to a longitudinal axis extending between the toe and heel latch members 76 and 78. As the lever arm 92 is rotated into the locked position, the chamfered lower ends of the first and second lock flanges 101*a* and 101*b* slide over the upper portion of the heel attachment rod 58. As the skater continues to rotate the heel latch member 78 into the locked position, the first and second lock flanges 101*a* and 101*b* continue to draw the heel attachment rod 58 firmly within the base portions of the first and second detents 106 and 108 and at least partially against the first and second abutment surfaces 107*a* and 107*b*. Thus, in the locked position, the heel attachment rod 58 is firmly seated within the base portion of the first and second detents 106 and 108 and is secured therein by the first and second lock flanges 101*a* and 101*b*.

To detach the shoe portion 22 from the frame 24, the skater would reverse the steps outlined above and rotate the lever arm 92 in a clockwise direction, thereby rotating the housing 90 into the open position. The skater would then lift the heel end 36 of the shoe portion 22 out the heel latch member 78 and, therefore, lift the heel attachment rod 58 vertically through the stems of the first and second detents 106 and 108 defined by the first slot 102. After the heel attachment rod 58 has cleared the upper surface of the housing 90, the skater would then slide the toe end 34 forwardly until the toe attachment rod 46 is freed from the hook portion 82 of the toe binding member 42.

The previously described versions of the present invention provide several advantages over skates currently available in the art. The skate of the present invention provides a shoe portion that is detachable from the skate frame, thereby providing the skater with comfortable footwear when detached from the skate frame without requiring the skater to carry additional footwear. The skate of the present invention also provides a latch mechanism that enables a solid and secure fastening of the skate frame to the shoe portion, thereby maintaining a rigid connection between the shoe portion and the skate frame during use. Furthermore, the latch mechanism of the present invention not only locks the shoe in a stationary position during use, but also provides easy mounting and dismounting of the shoe to the skate frame. Thus, the present invention offers a skate having a skate frame that is detachable from the shoe portion, thereby allowing the skater to convert the skate into comfortable footwear for walking when the shoe is detached from the skate frame.

From the foregoing description, it may be seen that the skate of the present invention incorporates many novel features and offers significant advantages over the prior art. It will be apparent to those of ordinary skill that the embodiments of the invention illustrated and described herein are exemplary only and, therefore, changes may be made to the foregoing embodiments. As a non-limiting example, the heel latch member 78 can be positioned forward of the heel end 36 of the shoe portion 22, such that the latch member selectively fastens either the arch or toe end of the shoe portion 22 to the frame 24. In this example, the free ends of the shoe portion not fastened to the frame by the latch member may be releasably secured to the frame by well known fastening members, such as a peg and hole, to restrain the shoe portion from rotating. As a second non-limiting example, although it is preferred that the heel latch member 78 is configured as a cylindrical element rotatably mounted within the frame 24, other embodiments of the heel latch member, such as a cross-country binding mechanism or pivoting-type binding mechanisms, are also within the scope of the present invention. Thus, it may be appreciated that various changes can be made to the preferred embodiment of the invention without departing from the spirit and the scope of the invention.

The embodiments of the invention in which an exclusive property or privilege is claimed are defined as follows:

1. A skate having a shoe portion detachably secured to a bearing member for traversing a surface, the shoe portion having a sole defining a heel end, a toe end, a lateral side, a medial side, and a metatarsal portion having a metatarsal head area, wherein the skate further comprises:

(a) a first latch rotatably attached to the bearing member, the first latch including a slot adapted to receive and couple an attachment surface located in the sole of the shoe portion to the frame; and (b) a release member attached to the first latch to selectively release the shoe portion from the first latch.

2. The skate of claim 1, wherein the release member comprises an elongate lever projecting horizontally from the first latch.

3. The skate of claim 2, further comprising an elongate frame having an upper surface and a lower surface, wherein the frame is disposed between the sole and the bearing member to attach the shoe portion to the frame.

4. The skate of claim 3, wherein the lever extends from the first latch towards the toe end and between the sole and frame to prevent unintentional release of the shoe portion from the first latch.

5. The skate of claim 4, further comprising a second latch attached to the upper surface of the frame for receiving and coupling a toe attachment surface located in the toe end of the sole to the frame.

6. The skate of claim 5, wherein the toe attachment surface is an elongate first rod disposed within a first cavity located in the toe end of the sole.

7. The skate of claim 6, wherein the rod is disposed within the first cavity such that the length of the rod is substantially normal to a longitudinal axis extending between the toe and heel ends of the sole.

8. The skate of claim 7, wherein the first latch is attached to the upper surface of the frame and wherein the first latch receives and couples a heel attachment surface located in the heel end of the sole to the frame.

9. The skate of claim 8, wherein the heel attachment surface is an elongate second rod disposed within a second cavity located in the heel end of the sole.

10. The skate of claim 9, wherein the second rod is disposed within the second cavity such that the length of the second rod is located substantially normal to a longitudinal axis extending between the toe and heel ends of the sole.

11. The skate of claim 10, wherein the first latch is a slotted cylinder adapted to receive and couple the heel attachment surface to the frame.

12. The skate of claim 11, wherein the first latch is rotatable about a vertical axis defined normal to the elongate direction of the frame to selectively secure the heel attachment surface to the frame, the first latch is rotatable between a closed position, wherein the heel attachment surface is nested therein, and an open position.

13. The skate of claim 12, wherein the slots of the first latch are chamfered to draw the heel attachment surface downwards against the frame as the first latch is rotated into the closed position.

14. The skate of claim 13, wherein the upper surface of the frame has a first upwardly projecting support mount adapted to support the sole of the footwear at a predetermined location behind the metatarsal head area of the sole and provide stable support to the shoe portion during use of the skate.

15. The skate of claim 14, wherein the upper surface of the frame has a second upwardly projected support mount adapted to support the sole of the footwear at a predetermined location behind the metatarsal head area of the sole, the first and second support mounts are located on the lateral and medial sides of the sole, respectively, to provide stable support to the shoe portion during use of the skate.

16. A skate having a shoe portion detachably secured to a bearing member for traversing a surface, the shoe portion having a sole defining a heel end and a toe end, wherein the skate further comprises:

(a) a frame having an upper surface and a lower surface attached to the bearing member;

(b) a first latch rotatably attached to the frame the first latch including a slot adapted to receive and couple a heel attachment surface located in the heel end of the sole to the frame; and (c) a release member attached to the first latch to selectively release the shoe portion from the first latch.

17. The skate of claim 16, further comprising a second latch attached to the upper surface of the frame for receiving and coupling to a toe attachment surface located in the toe end of the sole.

18. The skate of claim 17, wherein the first latch is attached to the upper surface of the frame and wherein the first latch receives and couples the heel attachment surface located in the heel end of the sole.

19. The skate of claim 18, wherein the first latch is rotatable about a vertical axis defined normal to the elongate direction of the frame to selectively secure the heel attachment surface to the frame, the first latch is rotatable between a closed position wherein the heel attachment surface is nested therein and an open position.

20. A skate having a shoe portion detachably securable to a bearing member for traversing a surface and a sole having a heel end and a toe end, wherein the skate further comprises:

(a) a frame having an upper surface and a lower surface, the lower surface is attached to the bearing member;

(b) a first latch rotatably attached to the frame, the first latch including a slot adapted for receiving and coupling a heel attachment surface located in the heel end of the sole to the frame;

(c) a second latch attached to the frame for receiving and coupling a toe attachment surface located in the toe end of the sole to the frame; and (d) a release member attached to the first latch to selectively release the shoe portion from the first latch.

21. The skate of claim 20, wherein the first latch is rotatable about a vertical axis defined normal to the elongate direction of the frame to selectively secure the heel attachment surface to the frame, the first latch is rotatable between a closed position wherein the heel attachment surface is nested therein and an open position.

22. A skate having a shoe portion detachably securable to a bearing member for traversing a surface, the shoe portion having a sole defining a heel end and a toe end, wherein the skate further comprises:

(a) a frame having an upper surface and a lower surface, the lower surface is attached to the bearing member;

(b) a first latch attached to the frame, the first latch includes a slot adapted to receive and couple a heel attachment surface located in the heel end of the sole to the frame, the first latch is positioned on the frame such that it is located between the sole of the shoe portion and the frame, the first latch is movable between a closed position to couple the heel binding attachment surface to the frame and an open position;

(c) a second latch attached to the frame for receiving and coupling a toe attachment surface located in the toe end of the sole to the frame; and (d) a release member attached to the first latch to selectively actuate the first latch between the open and closed positions.

23. A skate having a shoe portion detachably securable to a bearing member for traversing a surface, the shoe portion having a sole defining a heel end and a toe end, wherein the skate further comprises:

(a) a frame having an upper surface and a lower surface, the lower surface being fastened to the bearing member;

(b) a first latch attached to the frame the first latch including a slot adapted to receive and couple the sole of the shoe portion to the frame; and (c) a release member attached to the first latch to selectively release the shoe portion from the frame, the release member is positioned between the sole and the frame to prevent unintentional release of the shoe portion from the frame.

24. A skate having a shoe portion detachably secured to a bearing member for traversing a surface, the shoe portion having a sole defining a heel end, a toe end, a lateral side, a medical side, and a metatarsal portion having a metatarsal head area, wherein the skate further comprises:

(a) a first latch rotatably attached to the bearing member, the first latch including a slot adapted to receive and couple an attachment surface located in the sole of the shoe portion to the frame, the latch being rotatable about an upright axis; and (b) a laterally extending release member attached to the first latch to selectively release the shoe portion from the first latch.

25. A skate having a shoe portion detachably secured to a bearing member for traversing a surface, the shoe portion having a sole defining a heel end, a toe end, a lateral side, a medial side, and a metatarsal portion having a metatarsal head area, wherein the skate further comprises:

(a) a first latch rotatably attached to the bearing member for receiving and coupling an attachment surface located in the sole of the shoe portion to the frame;

(b) a release member attached to the first latch to selectively release the shoe portion from the first latch, wherein the release member comprises an elongate lever projecting horizontally from the first latch;

(c) an elongate frame having an upper surface and a lower surface, wherein the frame is disposed between the sole and the bearing member to attach the shoe portion to the frame, wherein the lever extends from the first latch towards the toe end and between the sole and frame to prevent unintentional release of the shoe portion from the first latch; and (d) a second latch attached to the upper surface of the frame for receiving and coupling a toe attachment surface located in the toe end of the sole to the frame, wherein the toe attachment surface is an elongate first rod disposed within a first cavity located in the toe end of the sole, wherein the rod is disposed within the first cavity such that the length of the rod is substantially normal to a longitudinal axis extending between the toe and heel ends of the sole, wherein the first latch is attached to the upper surface of the frame and wherein the first latch receives and couples a heel attachment surface located in the heel end of the sole to the frame, wherein the heel attachment surface is an elongate second rod disposed within a second cavity located in the heel end of the sole, wherein the second rod is disposed within the second cavity such that the length of the second rod is located substantially normal to a longitudinal axis extending between the toe and heel ends of the sole.

26. The skate of claim 25, wherein the first latch is a slotted cylinder adapted to receive and couple the heel attachment surface to the frame.

27. The skate of claim 26, wherein the first latch is rotatable about a vertical axis defined normal to the elongate direction of the frame to selectively secure the heel attachment surface to the frame, the first latch is rotatable between a closed position, wherein the heel attachment surface is nested therein, and an open position.

28. The skate of claim 27, wherein the slots of the first latch are chamfered to draw the heel attachment surface downwards against the frame as the first latch is rotated into the closed position.

29. The skate of claim 28, wherein the upper surface of the frame has a first upwardly projecting support mount adapted to support the sole of the footwear at a predetermined location behind the metatarsal head area of the sole and provide stable support to the shoe portion during use of the skate.

30. The skate of claim 29, wherein the upper surface of the frame has a second upwardly projected support mount adapted to support the sole of the footwear at a predetermined location behind the metatarsal head area of the sole, the first and second support mounts are located on the lateral and medial sides of the sole, respectively, to provide stable support to the shoe portion during use of the skate.

* * * * *